US005169363A

United States Patent [19]

Campanaro et al.

[11] Patent Number: 5,169,363

[45] Date of Patent: Dec. 8, 1992

[54] LOWER EXTREMITY REHABILITATION SYSTEM

[76] Inventors: Thomas J. Campanaro, 9225 Dowdy Dr., Suite 221, San Diego, Calif. 92126; Stanley W. Smith, 303 Garden Ter., Shorewood, Ill. 60436

[21] Appl. No.: 775,515

[22] Filed: Oct. 15, 1991

[51] Int. Cl.[5] ..... A63B 21/068

[52] U.S. Cl. ..... 482/96; 482/142

[58] Field of Search ..... 482/92, 79, 80, 95, 482/96, 131, 132, 133, 135, 142, 143, 144, 145, 146, 147

[56] References Cited

U.S. PATENT DOCUMENTS

| | | | |
|---|---|---|---|
| 2,733,922 | 2/1956 | Diego | 482/96 |
| 3,219,341 | 11/1965 | Weinstein | 482/96 |
| 3,602,501 | 8/1971 | Garner | 482/145 |
| 3,709,488 | 1/1973 | Garner | 482/145 |
| 3,892,404 | 7/1975 | Martucci | 482/145 X |
| 4,383,684 | 5/1983 | Schliep | 482/96 |
| 4,391,443 | 7/1983 | Beecroft | 482/145 |
| 4,700,946 | 10/1987 | Breunig | 482/96 X |
| 4,915,378 | 4/1990 | Abrahaman et al. | 482/145 X |
| 4,930,769 | 6/1990 | Nenoff | 482/96 |

*Primary Examiner*—Robert Bahr

[57] ABSTRACT

A physical therapy rehabilitation system for the legs, ankles and feet utilizes an inclined plane that has a torso-supporting platform on it which preferably slides up and down along the incline. At the lower end of the incline plane are attachments that permit the user to exercise the feet, ankles, calf muscles, knees, and other muscles in the lower extremities. One accessory comprises a wobble plate to permit rotation of the ankle in a controlled manner, and another permits plantarflexion. The inclined plane on which the patient's torso is supported is angularly adjustable so that varying proportions of the patient's body weight can be applied to the lower extremity that is being rehabilitated.

11 Claims, 2 Drawing Sheets

Fig. 8
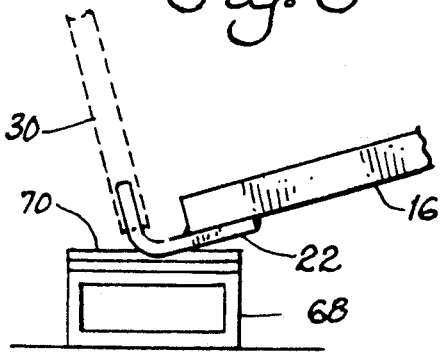
Fig. 9
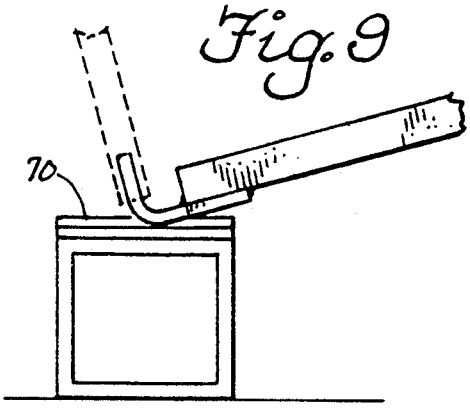
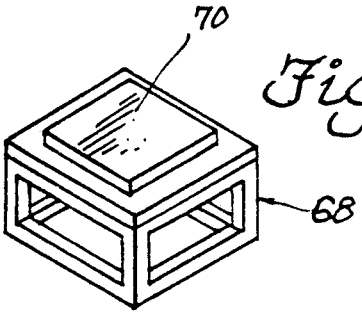
Fig. 10
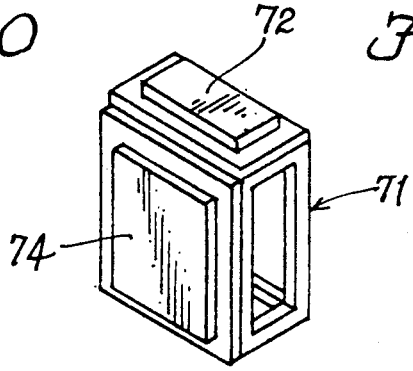
Fig. 11
Fig. 13
| LEVEL | SLOPE |
|---|---|
| 10 | 32° |
| 9 | 29° |
| 8 | 26° |
| 7 | 23° |
| 6 | 20° |
| 5 | 17° |
| 4 | 14° |
| 3 | 11° |
| 2 | 8° |
| 1 | 5° |
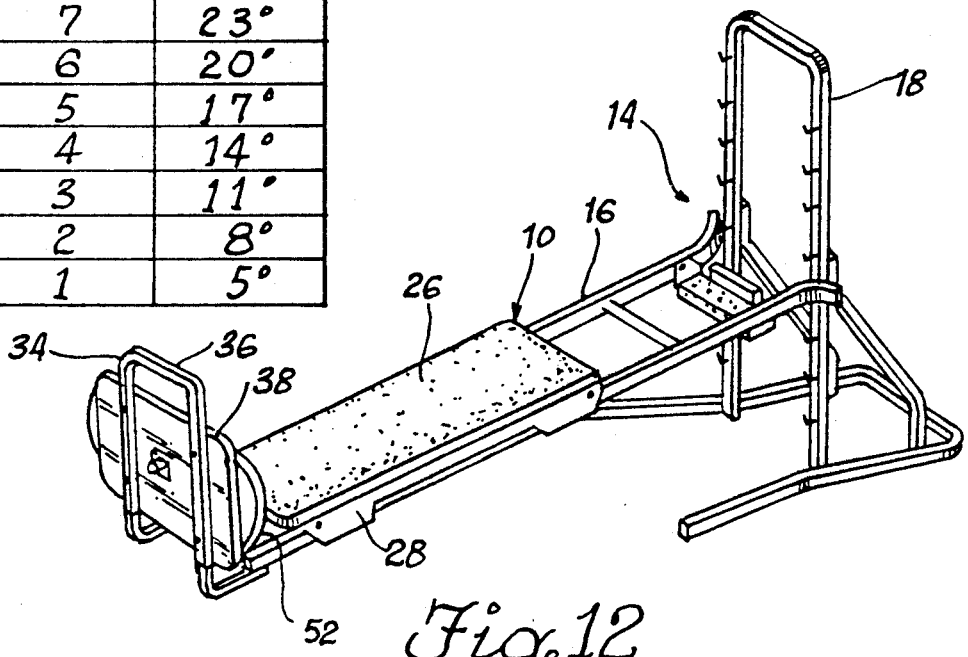
Fig. 12

LOWER EXTREMITY REHABILITATION SYSTEM

BACKGROUND OF THE INVENTION

The invention is in the field of rehabilitation, and more specifically relates to rehabilitation of the various joints, bones, and connective tissue in the lower extremities.

Recently, awareness of functional rehabilitation has increased substantially. More than ever before, physical therapists are turning to functional conditioning to rehabilitate their patients. Beyond merely resting in bed and waiting to heal, actually exercising the portion of the body that is being rehabilitated has proven to be vastly superior in many situations. Putting the injured portion of the body through the motions that it would ordinarily experience in daily life, beginning very slowly and increasing until full functionality is achieved, has proven to be a generally optimal rehabilitation procedure.

Motivating this trend back to real-life, or "functional" rehabilitation has been the study of the differences between open-chain and closed-chain functions of human movement, and how each satisfies a specific rehabilitation need. The terms "open-chain", and "closed-chain", refer, respectively to dangling one's leg over the edge of a table and swinging it back and forth, for example, as opposed to actually standing on that leg. "Open-chain" movement does not usually reproduce the actual movements or the weight-bearing experienced in real life. For this reason, today open-chain exercises are no longer being emphasized for lower extremity rehabilitation.

This practical, new results-oriented rehabilitation technique has produced a need for exercise equipment that makes possible these natural, functional exercise patterns for the rehabilitation patient. However, there is a difficulty when attempting to use natural human movements in a closed-chain fashion to rehabilitate the lower extremities. That is, when walking, for example, the patient must put his whole body weight on the leg that is being rehabilitated unless he uses a walker or some other body deloading crutch. For example, wobble boards on a flat surface are used to exercise an ankle that is being rehabilitated. If the ankle cannot take the full weight of the patient, the above-mentioned deloading support structure must be available.

As closed-chain functional rehabilitative conditioning continues to advance, there is a need for increasingly advanced rehabilitating equipment that permits the advantages of closed-chain exercise, while enabling the ankle, foot muscles, or other bone, joint or connective structure in the lower extremities to be conditioned.

SUMMARY OF THE INVENTION

The present invention is a closed-chain system designed to combine the rehabilitative advantages of closed-chain lower extremity exercise devices with an inclined plane torso supporting system which deloads body weight, in the preferred embodiment and the embodiment that is actually being produced, down to as little as 16% of the actual body weight. Actually, with an auxiliary cable release and hand hold system, the effective body weight can be reduced from 16% to as close to zero as is desired.

The closed kinetic chain (weight bearing) exercises in the deloaded state which the instant invention makes possible benefit the patient by facilitating muscle strength, coordination and proprioception in a functional movement pattern. Deloading an injured body part promotes healing through increased cellular metabolism while protecting it from further injury. While deloaded using the invention, the foot and ankle flexure accessories permit dorsiflexion, plantarflexion, foot inversion and eversion in the appropriate proportions. The system is used to increase range of movement at joints, strengthen connective tissue as well as bone, and proprioception training.

By use of the inclined plane, deloading allows a weakened foot or ankle to execute normal motions without being overpowered by body weight, as would be the case without the inclined plane structure. The adjustability of the inclined plane permits the clinician to progressively increase the effective body weight experienced by the weakened lower extremity as healing takes place and the increased weight is tolerated. The system is calibrated in terms of body weight percentages to give the clinician an objective means of assessing the patient's tolerance to weight bearing activities. In addition, the sliding torso support provides pelvic stability to the patient while exercising, which decreases the abnormal substitution patterns that would otherwise creep into the exercise to favor the injured tissue. In addition to ankle and foot rehabilitation, knees, thigh muscles, calf muscles, and the hip joint can also be exercised.

BRIEF DESCRIPTION OF THE DRAWINGS

FIG. 8 illustrates the lower end of the inclined plane rail structure supported on an elevation box;

FIG. 9 illustrates elevation of the lower end of the rail structure to a higher level by using the same box;

FIG. 10 illustrates an elevation box;

FIG. 11 illustrates a two-sided elevation box to provide the two different elevation height shown in FIGS. 8 and 9 from a single box;

FIG. 12 is a somewhat diagrammatic view of the inclined plane unit in perspective; and FIG. 13 is a chart providing the percentages of body weight that are experienced by the leg at various levels of incline.

DETAILED DESCRIPTION OF THE PREFERRED EMBODIMENT

Figure 1:
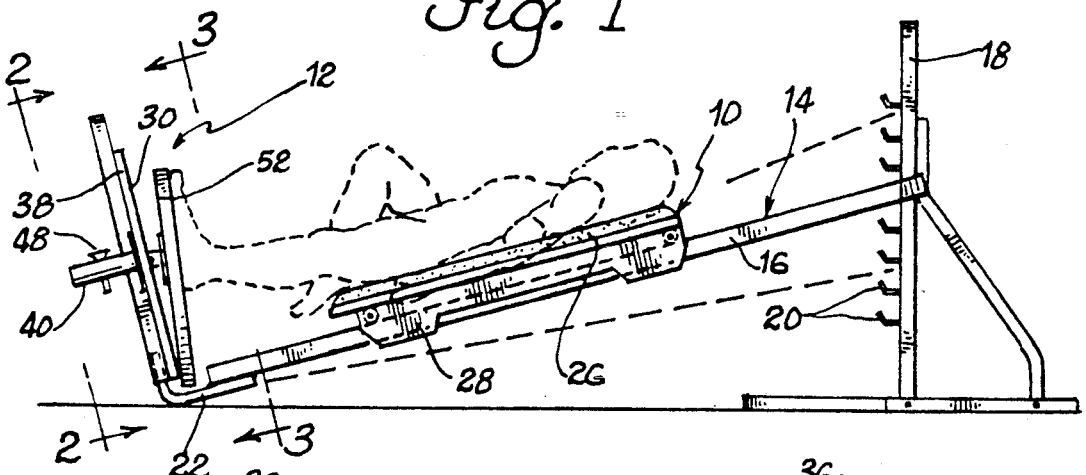
FIG. 1 is a somewhat diagrammatic side elevation view of the system used with a foot wobble plate.
Figure 2:
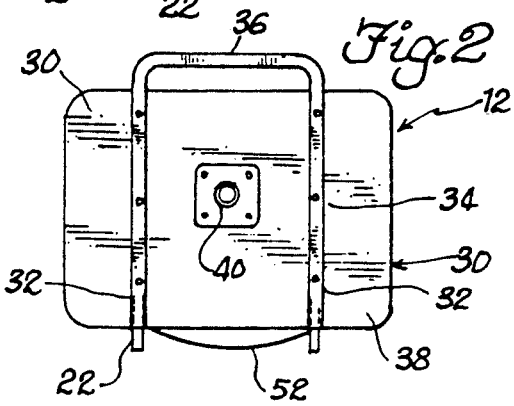
FIG. 2 is an end elevation view taken along line 2—2 of FIG. 1.

An inclined plane exercise device is shown at 10, having a wobble plate accessory 12 attached to it which is used for talocrural and foot muscle exercise. The exercise unit is similar in concept to one patented by the instant inventors and disclosed in U.S. Pat. No. 4,004.801, issued Jan. 25, 1977 for an Isotonic Exercise Unit. This unit has a rail structure comprising parallel rails 16 which define an inclined plane, and a stand 18 with hooks 20 which engage the upper, head end of the inclined plane structure defined by the rails 16 so that the amount of incline of the inclined plane can be varied, as shown in FIG. 13, with the lower, foot end of the inclined plane structure terminating in bars 22 that curve up to define upright posts 24 which are used for attaching the accessories which are discussed below.

Supported on the rail structure is a torso support platform 26. Although this platform could be stationary and still permit a number of exercises to be performed with the ankle and foot, in the preferred embodiment the platform is mounted on a carriage 28 which rides up and down the rails 16. The sliding movement of the carriage, or actually rolling movement, permits a much wider range of exercises to be executed on the machine, including meaningful deep knee bend and leg exercises.

Figure 7:
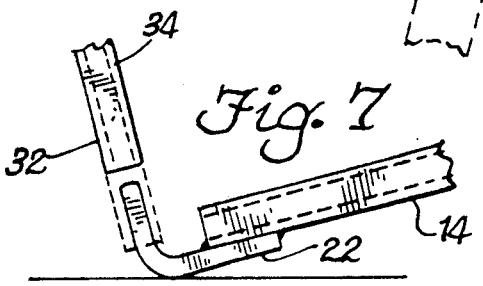
FIG. 7 is a detailed side elevation view of the upright post structure illustrating how the backing panel sleeves slip over the posts when adding the backing panel to the inclined plane unit.

Although no doubt more accessories will be added in the future, at present, and as disclosed in this disclosure, there are two, the first being the wobble board 12 mentioned above. The wobble board includes a backing panel 30 which defines two sleeves 32 which slip over the upright posts 24 at the foot end of the inclined plane structure as best shown in FIGS. 1 and 7. The sleeves are actually the lower ends of a U-shaped tube 34 which defines an upper handle loop 36 to facilitate carrying the wobble plate structure around.

Figure 4:
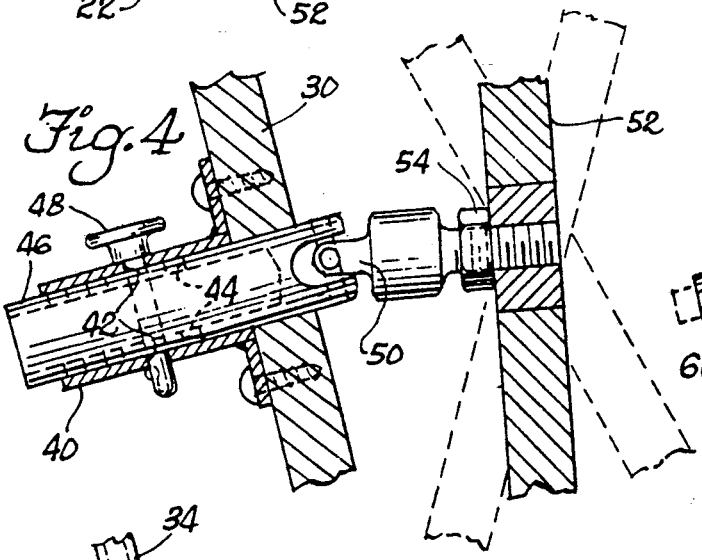
FIG. 4 is a somewhat diagrammatic section taken longitudinally and vertically through the universal joint area of the wobble plate, illustrating the wobble limit adjustability structure.

The panel 38 of the backing panel structure has a substantially centrally located, rugged metallic socket 40 defined in it as shown in FIG. 4. This socket has two aligned holes to define a through-bore 42 which selectively aligns with through-bores 44 in the shaft 46. The shaft 46 can thus be axially adjustably seated in the socket by removing and reinserting the pin 48 at different points of axial displacement.

The shaft 46 has a universal joint 50 designed in the portion of the shaft which is always forward of the planar backing panel 38 of the wobble board. The front end of the shaft is securely attached to the board in any fashion, shown being the threaded engagement of the board on a threaded forward end of the shaft 46, and tightened down with a retainer nut 54. As an alternative to the universal joint, the entire shaft could be made of a semi-flexible material, such as rubber, or some other yieldable material.

Figure 3:
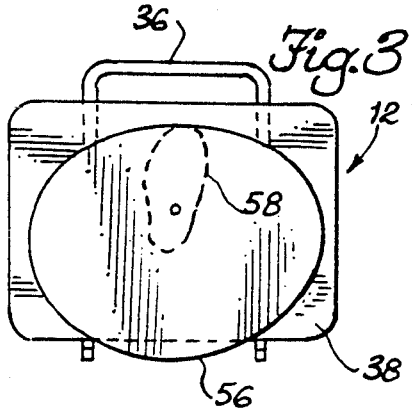
FIG. 3 is a section taken along 3—3 of FIG. 1.

As can be seen in FIGS. 1 and 3, the board 52 of the wobble board structure has a continuous perimeter 56 which will contact the backing panel 30 at any point around its perimeter, other than a small circular segment at the bottom of FIG. 3, as the wobble board is rotated. The contact between the perimeter of the board and the backing panel, of course, defines the limit of angular deflection of the board, and thus the angular movement of the ankle when the foot is rested in the position shown at 58 in FIG. 3. A single footprint 58 can be used, or the board 52 can be double-sided and easily reversible to accommodate more accurately the left and the right foot.

It can be seen that as the shaft 46 is progressively adjusted forwardly in the configuration in FIG. 4, the board 52 of the wobble board structure will be able to deflect at greater and greater angles. Thus for a particular patient, the wobble board structure might be used in its most recessed position, with the least amount of angular deflection possible, and gradually incremented until the patient is able to undergo the full range of motion at the ankle and full inversion and eversion of the foot permitted by the most radical position of the shaft in its socket.

The wobble board structure 12 is easily removed by slipping it off of the posts 24. No decent is needed, as gravity is quite adequate to hold the structure in place.

Figure 5:
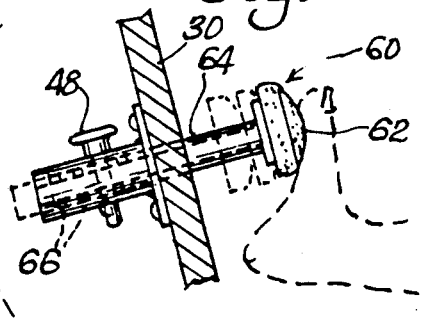
FIG. 5 is a longitudinal section taken through the footrest at its connection to the backing board, with the footrest being used for plantarflexion exercises by replacing the wobble plate in the backing panel socket.
Figure 6:
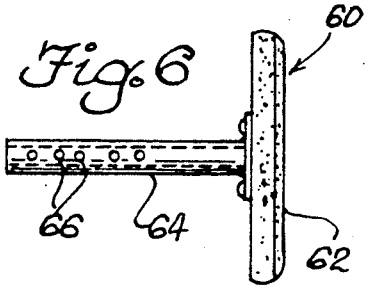
FIG. 6 is a top plan view of the footrest as it appears removed from the remaining apparatus.

When removed, it can be replaced by a footrest 60 having a padded crossbar 62 with a central stem 64, having its own through-bores 66. The stem is inserted into the socket 40 and pinned in place in identical fashion to the shaft 46. Because the footrest is also actively adjustable along its stem, when the ball of the footrests on the crossbar 62 as shown in FIG. 5, the backing panels 30 acts as a heel stop or heel rest to limit the degree of plantarflexion of the foot. In a close analogy to the rehabilitation therapy sequence using the wobble board, the footrest is adjusted from its most recessed position to an increasingly projected position to gradually increase, through several increments, the maximum amount of plantarflexion permitted.

It should be noted that the footrest 60 could be provided with its own heel stop so that it would be independent of the large backing panel 30. If this were the case, the U-tube and the panel element 38 would be replaced by a smaller, probably V-shaped tube which would mount a smaller board acting as the heel stop, as well as a socket similar to that indicated at 40. In addition, whereas the backing panel 30 is provided primarily to define 360 degree deflection limits for the wobble board, this limit could be effected with a much smaller structure, for example a ring concentric with the forward portion of the shaft 46, with some means of axially adjusting the spacing of the ring rearwardly of the wobble board element 52.

A last feature of the invention is illustrated in FIGS. 8 through 11. The lower, foot end of the inclined plane ordinarily rests on the floor in a room in a clinic. This is quite adequate for most people. However, elderly people or people with severe injuries have difficulty lowering and raising their bodies to and from the platform 26. To make the apparatus easier for them to use, an elevation means such as the spacer box 68 is provided which will raise the entire inclined plane, and especially the lower portion. Obviously this affects the degree of incline, and must be compensated at the upper end of the incline by raising the rail structure to a higher level of the hook 20.

The elevation box 68 may be a straightforward box as shown in FIG. 10, with a centering board 70, which keeps it between the two U-shaped tubes 34, or it could be a double-action box as indicated at 71 in FIG. 11, having two of the centering boards 70 on the top and side faces 72 and 74 of the box so that two different levels of elevation of the lower end of the inclined plane can be achieved.

It is very likely that additional accessories will be invented for attachments to the inclined plane exercise device. The ability of the inclined plane to deload the body in closed-chain exercises is proving to be so valuable in rehabilitation that very likely other attachments to accommodate specific other exercises will be developed. In any case, the invention represents another forward step in the increasingly sophisticated field of physical rehabilitation aimed toward returning injured persons as quickly and completely as possible to their full range of activity that they enjoyed prior to the disability.

It is hereby claimed:

1. A rehabilitation system for the lower extremities comprising:

(a) a frame defining an inclined plane of adjustable incline defining a lower, foot end, and an upper, head end;

(b) a torso support platform mounted on said frame parallel with said plane; and, (c) a wobble plate mounted through a universal joint to said frame at the lower foot end of said frame whereby a rehabilitation patient can recline on said platform, support his foot on said wobble plate, and perform rehabilitation exercises substantially comprising ankle rotation under adjustable levels of reduced joint compressive body weight.

2. Structure according to claim 1 and including elevation means for the lower end of said frame to facilitate the use of the system by the partially disabled, said elevation means comprising a removable spacer insertable between the lower end of said frame and the underlying surface on which said frame rests, with said spacer being a substantially rectangular block having a different dimension for each of its orthogonal dimensions such that the spacer defines three alternative spacing heights.

3. Structure according to claim 1 wherein said platform is slidable along the inclined plane of said frame.

4. Structure according to claim 1 wherein said system includes wobble limit means limiting the angular deflection of said wobble plate in substantially every direction.

5. Structure according to claim 4 wherein said wobble plate is substantially planar with a substantially continuous edge, and said wobble limit means comprises a substantially rigid backing panel spaced from said wobble plate on the side thereof remote from said platform, such that the edge of said wobble plate contacts said panel and is limited in angular deflection thereby at substantially all angles of wobble.

6. Structure according to claim 5 wherein said panel defines a substantially central socket extending orthogonally therethrough, and said wobble plate is attached to said panel by means of a shaft passing into said socket and seating therein, and said shaft defines said universal joint intermediate its ends to permit said wobble plate to wobble.

7. Structure according to claim 6 wherein said shaft is removable from said socket and including a footrest having a crossbar to support the foot and a stem to insert into said socket such that said footrest is usable with said panel alternatively to said wobble plate.

8. Structure according to claim 5 wherein said frame defines a pair of spaced upright posts at the foot end thereof such that said panel defines two spaced sleeves to slip over said posts to mount said panel to said frame.

9. Structure according to claim 8 wherein said sleeves define the downwardly-directed ends of a continuous tube looping up above the edges of said panel to define a handle loop.

10. Structure according to claim 6 wherein said wobble plate is removable from said socket and including a footrest having a shaft removably insertable into said socket, said footrest including a crossbar for the ball of the foot such that the patient can perform plantarflexion exercises and further including a heel support stage spaced below said crossbar and being more remote from said platform than said crossbar to define a limit of plantarflexion for the foot.

11. Structure according to claim 1 and including means to adjust the spacing between said crossbar and said heel support stage such that the maximum amount of planarflexion of the user is adjustable.

* * * * *